US005603199A

United States Patent [19]

Hammacher

[11] Patent Number: 5,603,199

[45] Date of Patent: Feb. 18, 1997

[54] SYSTEM FOR FEEDING AND DISTRIBUTING ARTICLES

[75] Inventor: Heinz-Peter Hammacher, Bamberg, Germany

[73] Assignee: PVT Piepenbrock Verpackungstechnik GmbH, Osnabruck, Germany

[21] Appl. No.: 431,762

[22] Filed: May 1, 1995

[30] Foreign Application Priority Data

May 3, 1994 [DE] Germany ..... 44 15 561.1

[51] Int. Cl.[6] ..... B65B 35/30

[52] U.S. Cl. ..... 53/443; 53/54; 53/543; 53/247

[58] Field of Search ..... 209/539; 198/433, 198/427, 358, 370.11; 901/7; 53/493, 54, 532, 247, 443, 448, 501, 543

[56] References Cited

U.S. PATENT DOCUMENTS

| | | | |
|---|---|---|---|
| 3,370,720 | 2/1968 | Schickle . | |
| 3,429,416 | 2/1969 | Provost et al. | 198/433 |
| 3,841,205 | 10/1974 | Mehaus | 198/358 |
| 4,214,663 | 7/1980 | Schopp et al. | 198/370.11 |
| 4,222,478 | 9/1980 | Gasser | 198/358 |
| 4,369,873 | 1/1983 | Keuft | 198/370.11 |
| 4,462,516 | 7/1984 | Guerzoni . | |
| 4,628,665 | 12/1986 | Kerrington | 53/25 L |
| 4,736,570 | 4/1988 | Hardage et al. . | |
| 4,866,910 | 9/1989 | Reist | 53/430 |
| 5,078,255 | 1/1992 | Haley | 198/358 |

FOREIGN PATENT DOCUMENTS

| | | |
|---|---|---|
| 217374 | 9/1961 | Austria . |
| 0082123 | 6/1983 | European Pat. Off. . |
| 2561207 | 9/1985 | France . |
| 1801165 | 11/1958 | Germany . |
| 1251208 | 9/1967 | Germany . |
| 1267592 | 5/1968 | Germany . |
| 1924123 | 3/1971 | Germany . |
| 2127705 | 8/1972 | Germany . |
| 7232986 | 9/1972 | Germany . |
| 2751697 | 6/1978 | Germany . |
| 3235632A1 | 3/1984 | Germany . |
| 3243500 | 5/1984 | Germany . |
| 3736610A1 | 5/1989 | Germany . |
| 9204040 | 5/1992 | Germany . |
| 3130103 | 10/1992 | Germany . |
| 1032543 | 6/1966 | United Kingdom . |
| 1274788 | 5/1992 | United Kingdom . |

*Primary Examiner*—John Sipos
*Assistant Examiner*—Gene L. Kim
*Attorney, Agent, or Firm*—Banner & Witcoff, Ltd.

[57] ABSTRACT

A method and a device are specified for feeding, arranging and distributing articles on a conveyor and for inserting the articles in receptacles, particularly for articles which are identical or similar to each other (monoproducts). The system involved is flexible and cost-effective in operation, with which articles of differing shape and size can be processed without any substantial alteration of its components. For this purpose, articles fed unarranged are gathered by means of gathering rails in lanes in juxtaposition and apportioned, counted and distributed according to the capacity of subsequent inserter means, to form groups having the same number of articles which are transferred into receptacles, whereby excess articles are diverted from one lane to a neighboring lane.

17 Claims, 4 Drawing Sheets

SYSTEM FOR FEEDING AND DISTRIBUTING ARTICLES

TECHNICAL FIELD

The present invention relates to a method and a device for feeding, arranging and distributing articles on a conveyor and for inserting the articles in receptacles. In particular, the method and the device according to the invention serve for feeding, arranging, distributing and inserting products of the confectionery industry which are identical or similar to each other such as chocolate-coated marshmellows or petit fours (monoproducts).

BACKGROUND OF THE INVENTION

It is generally so that feeding and inserting such articles is possible with the aid of mechanical inserter assemblies including suitably designed feeding systems or, however, with the aid of robotic devices employing visual or optical identification systems for robotic control.

Existing mechanical inserter systems lack flexibility as regards differing packing formations and packing contents. On top of this, existing feeding means are to disadvantage as regards a mechanical load imposed on the articles concerned (backup system with overflow).

The cost of employing expensive robotic devices having the necessary visual or optical identification systems for robotic guidance is often prohibitive.

SUMMARY OF THE INVENTION

An object of the present invention, therefore, is to create intelligent feeding means which due to their flexibility either have no need of any robotic device or in which, depending on the particular application, the number of necessary inserter assemblies is reduced to a minimum, taking into account the following prerequisites:

The articles, particularly products of the confectionery industry are usually incoming from upstream production systems (ovens, coating or molding systems etc) multi-channeled on belt conveyors, the arrangement between the individual rows of the product often being considerably disturbed due to the events involved in production (transfer events or changing conveyance conditions).

It is also often the case that the production quantities per unit of time are irregular, for example due to disturbances in upstream machines. Thus, for instance, complete rows of articles may fail over relatively long periods, should one of several upstream machines develop a fault.

It is furthermore frequent that the articles to be processed are irregular in shape or size and thus present highly particular demands on the feeding means for subsequent automated packaging.

On top of this disturbances or malfunctions in upstream means result in damage or other losses in quality which prove to be unacceptable.

Mechnical loads on the articles, particularly those of the confectionery industry, due to means of distribution, transfer, backup and the like often detriment the quality of the articles being processed or may even ruin them to such an extent that the inserter means need to be shut down entirely.

Known feeding and inserter means are able to process for example roughly 100 to 150 articles of the confectionery industry per minute, whilst in the interest of cost-effective procedures a capacity of 300 to 400 articles per minute needs to be attained, at least as regards relatively regularly-shaped products within certain tolerances.

All-in-all an object of the invention is to create a flexible, cost-effective system for feeding and inserting articles, with which articles of the same kind, but having differing shapes and sizes may be processed possibly without having to alter or change components and, if needs be, merely by undertaking certain adjustments.

The method according to the invention is characterized in claim 1, whilst the device according to the invention results from claim 7. The subclaims in each case contain further advantageous improvements and aspects of the invention.

Briefly, according to the invention, the articles are fed on a conveyor more or less non-arranged. By means of one or more gathering rails the articles are gathered on the conveyor in several lanes located adjacent to each other in the direction of conveyance. By this arrangement the total quantity of articles is apportioned into partial quantities, each of which is geared to the capacity of each inserter assembly. Subsequently, the articles in each lane are counted and distributed in one or more gathering chutes, so that arranged groups of articles having the same number of articles are formed on the conveyor. In the distribution means and in the gathering chutes respectively the groups of articles are halted, whilst the conveyor continues to run continuously. The groups of articles can thus be received by the inserter assembly.

Due to counting the articles introduced into the groups thereof and due to a comparison with the quantity removed, a correctional control is actuated which deviates the excess number of articles in each case from one lane into a neighboring lane, the excess number of deviated articles thereby being directed from the one lane in the direction of conveyance upstream of the point of counting, distribution and grouping in the other lane, into the latter. The groups of articles so formed are received from the gathering chutes arranged from each lane and transferred by means of an inserter to a receptacle and placed therein, said receptacle being transported on a separate conveyor means which is located alongside the article conveyor, parallel thereto.

With the aid of visual or optical identification means there is the possibility in said arrangement to sort out or reject faulty articles from the individual lanes prior to grouping. These sorted-out or rejected products are removed from the further processing sequence and thus are not included in packaging, thereby providing means of automatic quality control.

The possibility of diverting the stream of articles from one lane into a neighboring lane is also expedient should a fault occur in such arranging and inserter means, so that no further articles at all are removed. Then, all of the subsequent articles may be automatically directed with the aid of a diverting control into a neighboring lane for further processing there, without the complete system having to be shut down.

This makes it possible to process articles for instance on two lanes located adjacent to each other and to direct them to two separate inserter assemblies, whilst a third lane and a third inserter assembly remain available only for automatic standby operation in an emergency.

The total system of feeding, arranging, distributing and insertion of articles may be designed in such a way that mechanical loads on the articles are reduced to a minimum.

BRIEF DESCRIPTION OF THE DRAWINGS

Details and advantages of the invention will now be described in the following with reference to the drawing in which.

DETAILED DESCRIPTION

Figure 1:
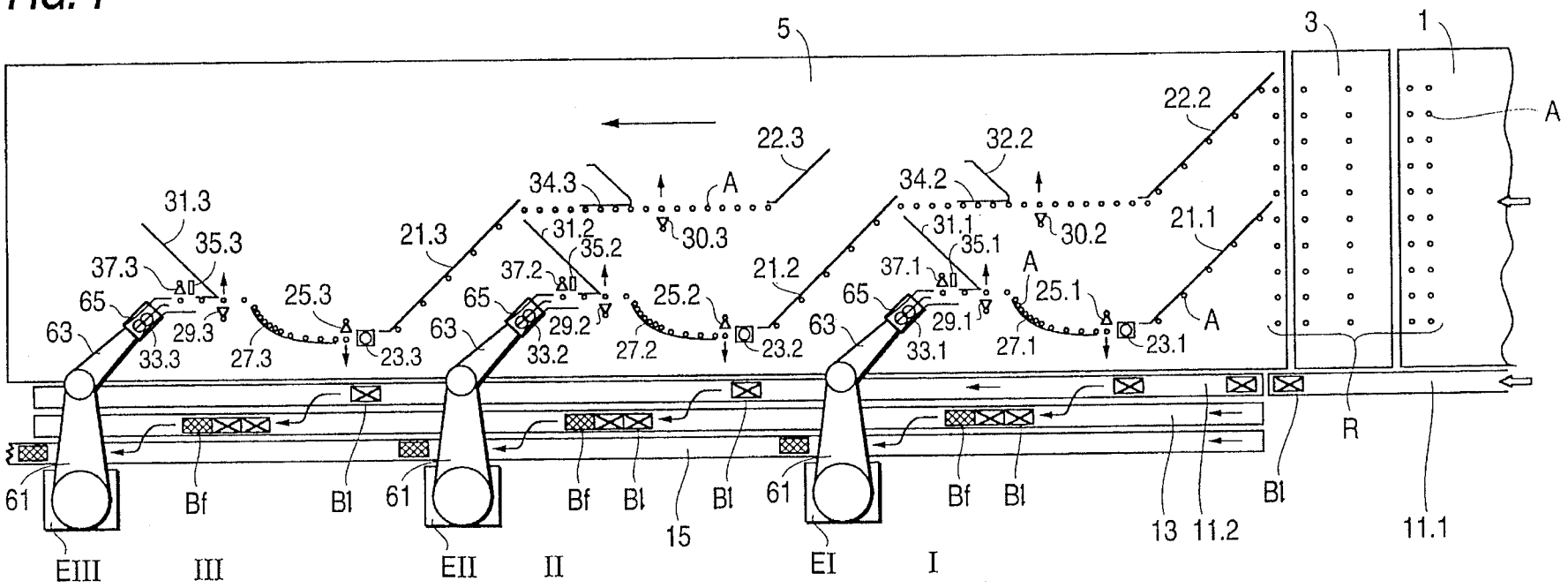
FIG. 1 is a schematic plan view of the overall arrangement of a device according to the invention having three inserter means.

As illustrated in particular by FIG. 1 the articles A to be processed are incoming from a production machine on a feeder conveyor 1 in more or less orderly or arranged cross rows R. The articles A are transferred to an acceleration conveyor 3, by means of which the rows R are elongated in the direction of conveyance. After this, the rows R of the articles A attain a main conveyor 5, on which they are further elongated by acceleration in the direction of conveyance and on which they are processed by means of three distribution and insertion means I, II and III, as described in detail below. Subsequently, the articles are placed in empty receptacles Bl incoming on a conveyor 11.1 and which are transferred to a further conveyor 11.2 running in parallel alongside the main conveyor 5. Alongside the conveyor 11.2 a filler section 13 runs in parallel on to which the empty receptacles Bl are transferred and on which they are filled with the articles A so that on the filler section 13 empty receptacles Bl and filled receptacles Bf run. From the filler section 13 the filled receptacles Bf are transferred to a gathering conveyor 15 for filled receptacles Bf. The conveyors 11.2, 13 and 15 run parallel to each other alongside the main conveyor 5. Transfer of the receptacles B from the one conveyor to the other is done by means of known devices, e.g. sweeper devices.

With reference to FIG. 1 the distribution and insertion means I will now be described.

Above the main conveyor 5 a gathering rail 21.1 is arranged, on which the articles A are lined up to form a lane of articles in sequence. The articles are fed in further sequence to the distribution and insertion means I. The distribution and insertion means I operate independently of the distribution and insertion means II and III so that differing partial quantities sometimes fed to the individual distribution and insertion means result in no disturbance whatsoever to the course of operations.

At the end of the gathering rail 21.1 a device for optically or visually identifying 23.1 the articles may be disposed, thus providing for quality control of the incoming articles. By means of the identification device 23.1 a discharge or rejector means 25.1 following in the direction of conveyance may be controlled, which has, for instance, a blower nozzle, by means of which defective or damaged articles can be removed to the side of the conveyor, as indicated by the arrows, i.e. to a region of the main conveyor 5 provided on the side for this purpose. These reject articles run to the end of the main conveyor 5 where they may be retrieved.

Following the components of the means already described a preferably curved or bent feeder rail 27.1 is provided, along which the articles A are lined up shoulder-to-shoulder. A curved feeder rail 27.1 is better suited than a straight feeder rail for transferring the articles A to the downstream sub-assemblies. By suitably forming the radius of curvature at the end of the feeder rail 27.1 a consistent minimum spacing between the articles A supplied may be achieved or maintained even when feeding is inconsistent.

Should the articles A supplied by the feeder rail 27.1 not be able to be accepted by the downstream device, these articles A may be diverted to the side transverse to the direction of conveyance by diverting means 29.1 located downstream of the feeder rail 27.1, these means being formed in turn by a blower nozzle, for instance, on to a diverter rail 31.1 which directs the diverted articles to the next distribution and insertion means II. To avoid an excessive or roughly twice the volume of articles being supplied to the latter means, a further diverting means 30.2 is also provided at device II, which for example may again be a blower nozzle, which diverts the articles originally intended for the means II either fully or partially to the subsequent means III. Actuation of the diverting means 29.1 and/or 30.2 and the corresponding blower nozzles respectively is done via displacement sensing, i.e. a pulse generator driven by the main conveyor 5 precisely senses the position of the individual articles A, thus creating the condition for suitably actuating the diverting means 29.1 and 30.2.

Employing blower nozzles for diverting the articles A is to be preferred, these constituting a means which is fast, kind to the product, not confined to any particular shape and also cost-effective.

Figure 2:
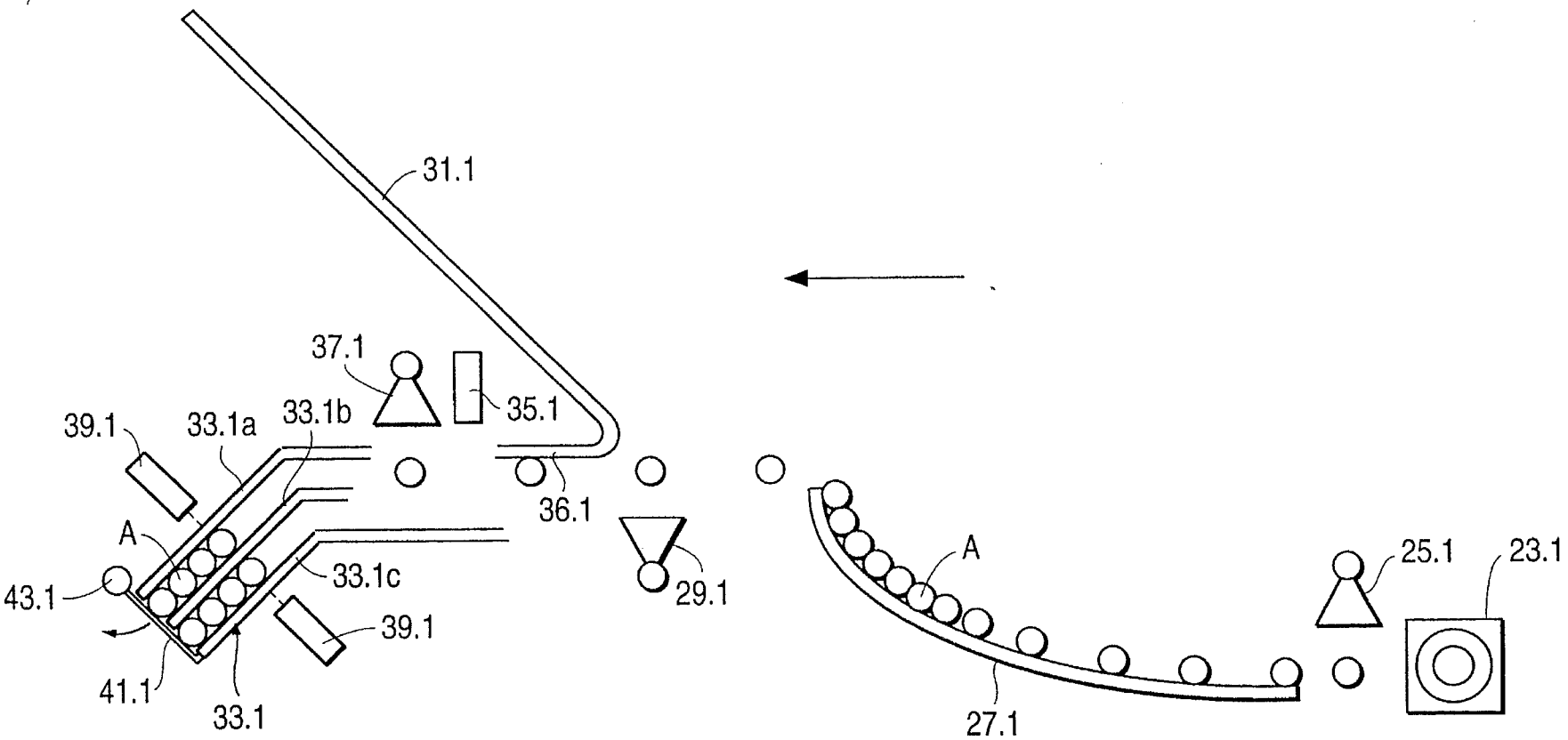
FIG. 2 is a schematic enlarged plan view of feeding the articles to a inserter means, parts of which have been omitted to facilitate a clear representation.
Figure 3:
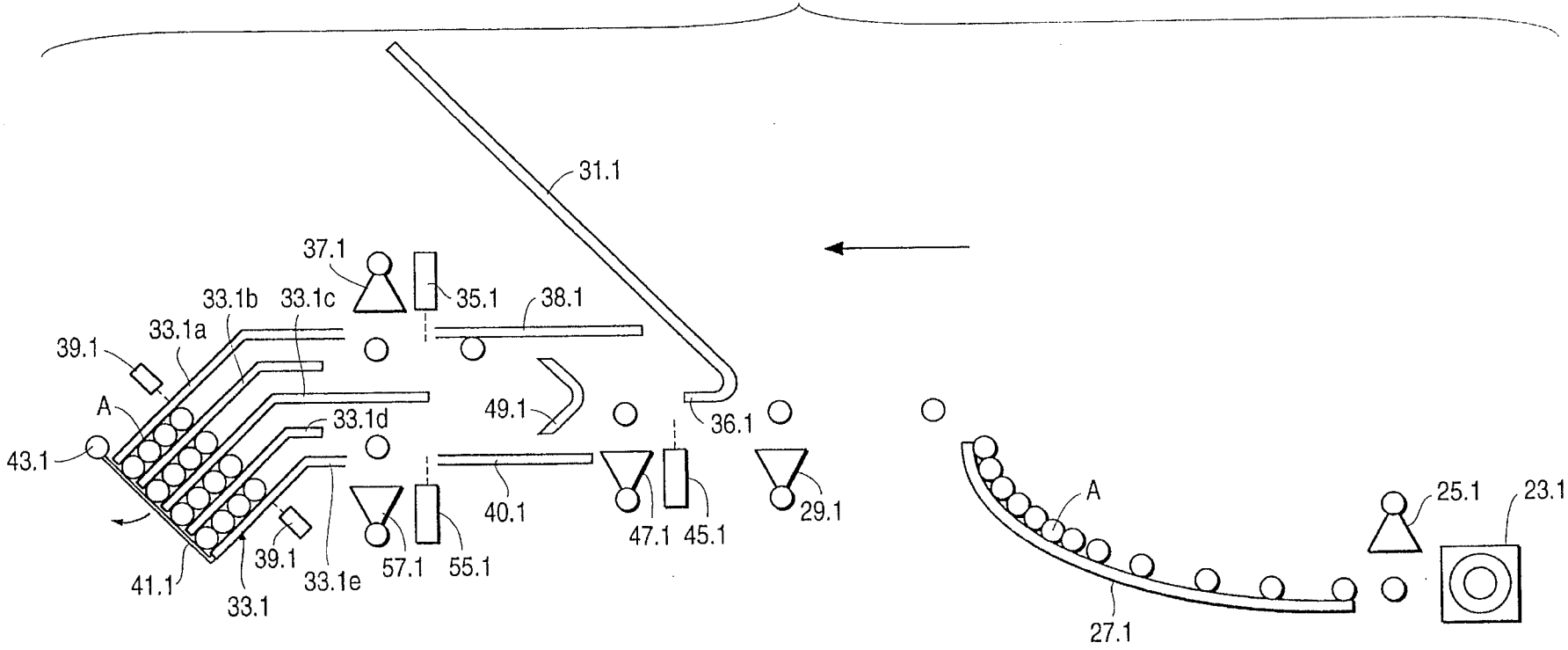
FIG. 3 is an illustration similar to that of FIG. 2, in which the articles are distributed not in two rows but in four.

The parts hitherto described of the distribution and insertion means I are illustrated on a magnified scale in FIG. 2, as are the parts of the device as described in the following. Downstream of the feeder rail 27.1 the articles A are income in the inserter zone of a gathering chute 33.1 under normal operating conditions. The latter is formed comb-shaped by partitions 33.1*a*, 33.1*b* and 33.1*c*, by means of which a two-row formation of articles may be formed. In an arrangement of several partitions corresponding multiple rows of articles may be formed in the gathering chute 33.1, as illustrated in FIG. 3. These formations of articles correspond to the packing content or packing pattern of the receptacle Bf to be filled or, in the case of larger receptacles, the portion of the receptacle content in each case.

Within the comb-shaped gathering chute 33.1 the articles A are caused to back up. Due to the slanting arrangement of the gathering chute 33.1 with respect to the conveying direction of the main conveyor 5 the backup pressure on the first article A in each case is reduced ahead of a stop 41.1 to thus reduce the risk of the article being damaged. The stop 41.1 forms practically a zero line for lining up the articles. A second zero line is formed by the side partitions 33.1*a*, 33.1*b* and 33.1*c*, with which the articles come into contact due to the slanting arrangement. Accordingly, two zero lines result to permit precise lining up of the articles even in the case of differing sizes. Furthermore, this arrangement permits processing articles differing in shape within certain limits without having to change the gathering chute.

The stop 41.1 is pivotally mounted on a pivot pin 43.1, so that even if the articles A fail to permit proper removal from the gathering chute 33.1, they can be released from the gathering chute 33.1 by pivoting the stop 41.1 and, like the articles ejected by the diverting means 25.1, deposited on the side region of the main conveyor 5, at the end of which they are retrieved.

At the inlet of the gathering chute 33.1 downstream of the diverting means 29.1 a counter means 35.1, e.g. in the form of a light barrier, is provided which controls a distributing means 37.1, again for example in the form of a blower nozzle, such that the articles A are distributed in precise number in the individual rows of the gathering chute 33.1, so that in turn unnecessary backup pressure is avoided or reduced in the individual rows.

Between the diverter means 29.1 and the counter means 35.1 it is of advantage to arrange for a short guide 36.1 for the articles A, to precisely feed them to the gathering chute 33.1 in the conveying direction.

At the gathering chute 33.1 a further counter means 39.1, e.g. a light barrier, is arranged to establish when the gathering chute 33.1 is full. This light barrier triggers, on the one hand, the release for receiving the articles by the corresponding inserter E1 and, on the other, it controls the diverter means 29.1 for diverting further articles A to the diverter rail 31.1. This results e.g. when due to a disturbance the articles cannot be retrieved from the gathering chute 33.1.

The stop 41.1 at the end of the gathering chute 33.1 may be pivoted for example by pneumatic or electronic means automatically, or if required, also manually to permit discharge of the articles A from the gathering chute 33.1 in case of a disturbance.

As shown in FIG. 1 an inserter I is assigned to the gathering chute 33.1 with which the articles may be transferred from the gathering chute 33.1 into a receptacle B. Pivotally mounted on the side alongside the receptacle conveyors 11.2, 13 and 15 the inserter I has a pivot arm 61, on which an inserter arm 63 is pivotally mounted, the free end of which carries an article receiver 65. The latter is pivoted above the gathering chute 33.1 and removes the articles A having gathered therein from the top, for example by means of mechanical or pneumatic grippers. By pivoting the pivot arm 61 and the inserter arm 63 the articles A removed from the gathering chute 33.1 are brought into position above an empty receptacle Bl and inserted therein, by the articles being released from the article receiver 65. In this arrangement the articles retain their same assignments to each other in the filled receptacle Bf as in the gathering chute 33.1. Depending on the particular application concerned it is generally possible that all known kinds of inserters, such as mechanically or servo-operated two-axle assemblies, but also robotic inserters may be employed.

To permit insertion of the articles in receptacle B, suitable stop and centering means for the empty receptacles Bl to be filled are assigned to the inserter I on the filling section. These means are not illustrated in the drawing. The length of the filling section 13 forms, at the same time, an intermediate buffer for empty receptacles Bl, as useful or necessary for the allocation of empty receptacles Bl from the conveyor 11.2 to the filling section 13. The transfer of the filled receptacles Bf from the filling section 13 to the gathering conveyor 15 is achieved in turn by sweeping as is known. By suitable stop and control means a region on the gathering conveyor 15 is maintained free for transfer of a filled receptacle Bf at the right time in each case.

The second distribution and insertion means II is in principle configured in the same way as the first distribution and insertion means I. The second means II thus has firstly a gathering rail 22.2 and the aforementioned diverter means 30.2 from which excess articles are diverted to a diverter rail 32.2. The articles remaining in the means II are directed along a guide 34.2 together with any articles incoming from the diverter rail 31.1 to a gathering rail 21.2 corresponding to said gathering rail 21.1 of the first means I. From here on the means II is configured in the same way as the means I, it thus having a means 23.2 for visual or optical identifiction of articles as well as a diverting means 25.2 to which a preferably curved feeder rail 27.2 connects. This is followed by a diverting means 29.2 to permit the diversion of articles A to a second diverter rail 31.2 should a disturbance occur. For the actual stream of articles this in turn is followed in the means II again by a gathering chute 33.2, upstream of which a counter means 35.2 and a distributing means 37.2 are arranged. The gathering chute 33.2 is configured in the same way as the gathering chute 33.1. The inserter II too, is configured and operates in the same way as inserter I.

In conclusion, FIG. 1 illustrates a third distribution and insertion means III, which is configured analogously to the two aforemented means I and II. Accordingly means III features at the start of its inlet end a gathering rail 22.3, a diverter means 30.3 for a diverter rail 32.3 and a guide 34.3, to which the gathering rail 21.3 proper connects, followed by an optical identification means 23.2 and a discharge means 25.3 as well as by a feeder rail 27.3, again preferably curved. By means of a diverter means 29.3 excess articles can be conveyed to a diverter rail and retrieved at the end of the main conveyor 5. The main article stream is directed however to a gathering chute 33.3, upstream of which again a counter means 35.3 and a distributing means 37.3 are arranged. In conclusion an inserter III is provided which is configured and operates in the same way as the two inserters I and II described previously.

Compared to known mechanical insertion devices or robotic-assisted devices the device as specified above and its method of operation offer essentially the following advantages:

1. The device is flexible as regards the formation of differing groups of articles.

2. The device is flexible as regards processing a variety of different articles but each identical to the other.

3. Due to the provision of counted groups of articles or products a high insertion capacity is achievable, thus enabling the number of inserters I to III to be considerably reduced. This savings factor can be of the magnitude 2 or 3, depending on the case in question. The additional costs for the feeder system specified herein bear no relation to the costs caused by a high number of inserters.

4. Due to the reduced number of inserters the overall space requirement for the complete inserter means can be reduced in magnitude again by a factor of 2 to 3, relative to the length of the system.

5. Unlike robotic devices having visual identification means, in which at least four controlled axes are necessary, assemblies suffice for the inserters I to III according to the invention which are capable of operating in two axial directions (mechanically powered, pneumatically powered or servo-powered units).

6. Even in a feasible application including robotic devices, e.g. when partial quantities of a receptacle filling need to be inserted, the required number of robotic devices is reduced, since the articles are made available to the robotic devices and thus these are merely required to cover the distances between the receiving point and the releasing point in each case within the receptacle. By contrast, when employing robotic devices having a visual identification system for their guidance and a multiple gripper device, all articles must first be gripped individually before they can be inserted in unison.

In normal operation of the device according to the invention only the distribution and insertion means I and II with the inserters E I and E II are in operation. The third distribution and insertion means III with the inserter E III operates only on standby for excess articles A which cannot be processed by the two previous means I and II and are diverted therefrom.

FIG. 3 illustrates a device in which the gathering chute 33.1 accommodates not two, but four rows of articles A. Like parts are identified by like reference numerals as in FIG. 1 and FIG. 2. Here, however, for the four rows of articles a total of five partitions 33.1*a*, 33.1*b*, 33.1*c*, 33.1*d* and 33.1*e* is provided. Also, in addition to the counter means 35.1 and the distributor means 37.1 a second counter means 55.1 and a second distributor means 57.1 are provided in each case on the opposite side at the inlet to the gathering chute 33.1. Thus, each of these means controls the articles for two of the four lanes of the gathering chute 33.1. Upstream of this arrangement, in the inlet region of the gathering chute 33.1 a further counter means 45.1, a diverter means 47.1 and a v-shaped guide 49.1 are provided. By means of these components the incoming articles A are first split into two lanes along the guides 38.1 and 40.1, Otherwise, the device as shown in FIG. 3 corresponds to the means as described above with reference to FIG. 2. The articles may be removed in the same way from the four lanes of the gathering chute 33.1. shown in FIG. 3 by means of an inserter E I and inserted in receptacles, as already described above.

Figure 5:
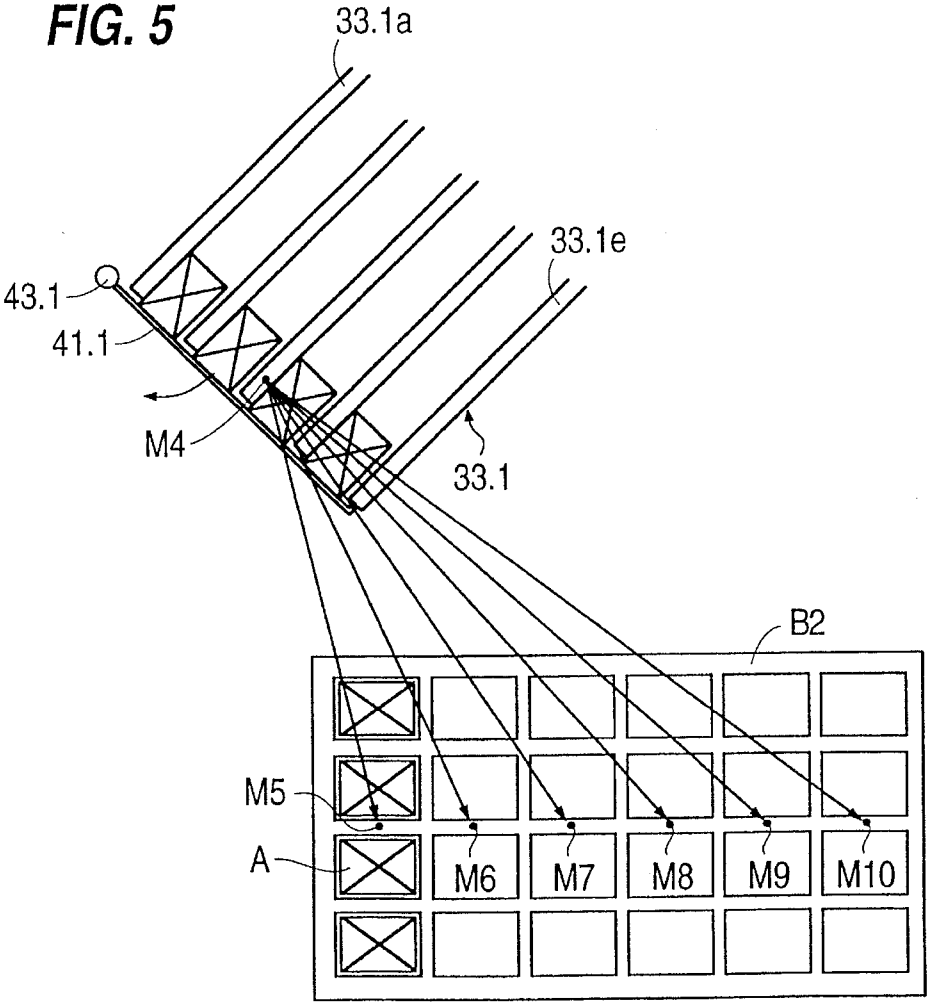
FIGS. 4 and 5 demonstrate the flexibility of the feeding system in feeding the articles in four rows to an inserter means and in inserting the thereby formed groups of articles in receptacles.
Figure 4:
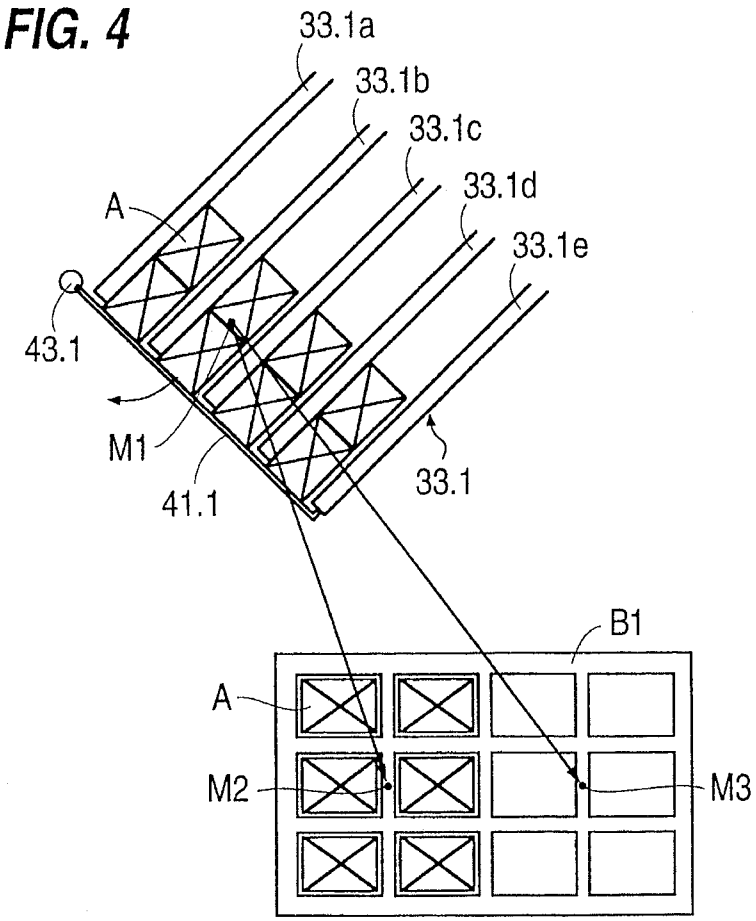

In conclusion FIGS. 4 and 5 illustrate the flexibility of the feeder system. As an example a four-lane article feeding arrangement as shown in FIG. 3 was selected. By programming and controlling the distribution and insertion means accordingly, corresponding partial quantities of a receptacle Bf to be filled may be fed to the gathering chute 33.1 and thus to the inserter EI and held in readiness for inserting. The points M1 to M10 each designate the center points of the gripper of the inserter EI in each case as located above the gathering chute 33.1 and above a receptacle Bl or B2 respectively.

By these means and without necessitating conversion work on the device itself, a variety of pack formations can be generated simply by changing the programming and the control. The only part requiring changing in this respect is the gripper element or gripper 65 on the inserter EI.

| Reference Numerals | |
|---|---|
| A | articles |
| B | receptacle |
| Bf | filled receptacle |
| B1 | empty receptacle |
| R | cross rows of articles |
| I | 1st distribution and insertion means |
| II | 2nd distribution and insertion means |
| III | 3rd distribution and insertion means |
| EI | inserter I |
| EII | inserter II |
| EIII | inserter III |
| M | center points |
| 1 | feeder conveyor |
| 3 | acceleration conveyor |
| 5 | main conveyor |
| 11.1 | conveyor for empty receptacles, 1st part |
| 11.2 | conveyor for empty receptacles, 2nd part |
| 13 | filler section for receptacles |
| 15 | gathering conveyor for filled receptacles |
| 21.1 | gathering rail I |
| 21.2 | gathering rail II |
| 21.3 | gathering rail III |
| 22.2 | gathering rail II |
| 22.3 | gathering rail III |
| 23.1 | optical/visual identification I |

-continued

| Reference Numerals | |
|---|---|
| 23.2 | optical/visual identification II |
| 23.3 | optical/visual identification III |
| 25.1 | rejector I |
| 25.2 | rejector II |
| 25.3 | rejector III |
| 27.1 | feeder rail I |
| 27.2 | feeder rail II |
| 27.3 | feeder rail III |
| 29.1 | diverter I |
| 29.2 | diverter II |
| 29.3 | diverter III |
| 30.2 | diverter II |
| 30.3 | diverter III |
| 31.1 | diverter rail I |
| 31.2 | diverter rail II |
| 31.3 | diverter rail III |
| 32.2 | diverter rail II |
| 32.3 | diverter rail III |
| 33.1 | gathering chute I |
| 33.2 | gathering chute II |
| 33.3 | gathering chute III |
| 33.1a | partition |
| 33.1b | partition |
| 33.1c | partition |
| 33.1d | partition |
| 33.1e | partition |
| 34.2 | guide II |
| 34.3 | guide III |
| 35.1 | counter means I |
| 35.2 | counter means II |
| 35.3 | counter means III |
| 36.1 | guide I |
| 37.1 | distributor means I |
| 37.2 | distributor means II |
| 37.3 | distributor means III |
| 38.1 | guide |
| 39.1 | light barrier |
| 40.1 | guide |
| 41.1 | stop pivotable |
| 43.1 | pivot axis |
| 45.1 | counter means |
| 47.1 | distributing means |
| 49.1 | guide |
| 55.1 | counter means |
| 57.1 | distributing means |
| 61 | pivot arm |
| 63 | inserter arm |
| 65 | article receiver, gripper |

I claim:

1. A method of feeding, arranging and distributing articles on a conveyor and of inserting the articles in receptacles characterized by feeding said articles on said conveyor, gathering and apportioning said incoming articles into partial quantities roughly corresponding to the capacity of downstream removal and transfer steps in individual lanes located juxtaposed in the direction of conveyance, counting and distributing said articles from each individual lane to form regular groups having the same number of articles, at different locations on said conveyor for each individual lane halting said groups of articles from each individual lane on said continuously running conveyor at different locations, diverting articles that are in excess of the number of articles in said groups from one lane into a neighboring lane at the position for counting and distributing said articles in the lanes, removing said groups of articles from said conveyor, transferring each group of articles in a regular formation into a receptacle.

2. The method as set forth in claim 1, characterized in that said articles are fed to said conveyor in cross rows and that said rows prior to or during feeding to said conveyor are elongated in the direction of conveyance by acceleration.

3. The method as set forth in claim 2, characterized in that said cross rows are additionally elongated in the direction of conveyance by acceleration of an acceleration conveyor prior to being fed to said conveyor.

4. The method as set forth in claim 1, characterized by visual identification of said articles in the individual lanes, rejection of defective articles from the lanes prior to counting and grouping.

5. The method as set forth in claim 1, characterized in that said excess articles diverted from the first lane are gathered on a neighboring second lane, where they are merged with said articles incoming directly on said second lane, and that said merged articles on said second lane are counted and distributed for grouping.

6. The method as set forth in claim 5, characterized in that a number of articles incoming directly on said second lane corresponding to the number of said diverted excess articles is diverted on to a further neighboring lane.

7. A device for feeding, arranging and distributing articles on a conveyor and for inserting the articles in receptacles, characterized by a conveyor provided for said articles, gathering rails located above said conveyor for forming lanes of articles arranged in juxtaposition in the direction of conveyance, a counting and distributing means located in the direction of conveyance downstream of the gathering rails, said counting and distributing means having a gathering chute arranged for each lane of said articles, at a different location for each individual lane for forming regular group of said articles, diverter means provided upstream of said counting and distributing means for diverting articles that are in excess of the number of articles in said groups to a neighboring lane, said diverter means being arranged in the direction of conveyance upstream of said counting and distributing means of said neighboring lane, a means for receiving, in the region of said gathering chute of each lane, said groups of articles in regular formation from said gathering chute and for inserting said groups of articles into one receptacle each a conveyor for the receptacles running alongside said article conveyor and in parallel thereto.

8. The device as set forth in claim 7, characterized in that upstream of said counting and distributing means of each lane an optical means is arranged for identifying said articles and a rejection means is arranged for rejecting defective articles.

9. The device as set forth in claim 8, characterized in that a curved feeder rail is arranged between said rejection means and said diverter means.

10. The device as set forth in claim 7, characterized in that:

said device is operative to form two adjacent lanes of articles on said conveyor, said lanes having associated therewith, respectively, two gathering rails, two feeder rails, two diverter means, two counting and distributing means and inserter means for inserting articles into a receptacle, said gathering rail of said second lane is divided into two partial gathering rails, a first of which is located in the direction of conveyance alongside the gathering rail of said first lane and a second of which is located in the direction of conveyance downstream of the gathering rail of said first lane, a diverter rail for the articles to be diverted from said first lane to said second lane is provided in the region of said diverter means of said first lane, said diverter rail leading to said second partial gathering rail, and in that said counting and distributing means said feeder rail and said inserter means of said second lane are located in the direction of conveyance downstream of the corresponding means of said first lane.

11. The device as set forth in claim 10, characterized in that in the direction of conveyance downstream of the said second counting and distributing means and said second inserter means a third such means of the same kind is provided which operates in a standby mode.

12. The device as set forth in claim 10, characterized in that a rejection means is provided upstream of said second counting and distributing means.

13. The device as set forth in claim 7, characterized in that a diverter rail for the articles is provided downstream of said diverter means.

14. The device as set forth in claim 7, characterized in that said gathering chute is comb-shaped with partitions, located at an angle of roughly 30° to 45° to the direction of conveyance of said conveyor.

15. The device as set forth in claim 7, characterized in that said counting and distributing means and said gathering chute are configured such that in keeping with a desired packing pattern of a receptacle preprogrammed, differing quantities of said articles are receivable in differing arrangement and held in readiness for a corresponding inserting means.

16. The device as set forth in claim 10, characterized in that a common through-running receptacle conveyor is provided for supplying receptacles to each of said inserter means.

17. The device as set forth in claim 16, characterized in that said receptacle conveyor has a conveyor for empty receptacles, a filler section running in parallel thereto for the receptacles and a gathering conveyor running parallel thereto for the filled receptacles.

* * * * *